US005568725A

United States Patent [19]

Uchikawa

[11] Patent Number: 5,568,725

[45] Date of Patent: Oct. 29, 1996

[54] APPARATUS AND METHOD FOR CONTROLLING THE AIR-FUEL RATIO OF AN INTERNAL COMBUSTION ENGINE

[75] Inventor: Akira Uchikawa, Atsugi, Japan

[73] Assignee: Unisia Jecs Corporation, Atsugi, Japan

[21] Appl. No.: 277,273

[22] Filed: Jul. 21, 1994

[30] Foreign Application Priority Data

Jul. 26, 1993 [JP] Japan ..... 5-184157

[51] Int. Cl.[6] ..... F01N 3/20

[52] U.S. Cl. ..... 60/274; 60/276; 60/277; 60/285; 123/688

[58] Field of Search ..... 60/274, 276, 277, 60/285; 123/688

[56] References Cited

U.S. PATENT DOCUMENTS

| | | | |
|---|---|---|---|
| 4,980,834 | 12/1990 | Ikeda | 123/688 |
| 5,168,700 | 12/1992 | Furuya | 60/274 |
| 5,331,808 | 7/1994 | Koike | 60/277 |
| 5,337,558 | 8/1994 | Komatsu | 60/276 |
| 5,414,995 | 5/1995 | Tokuda | 60/277 |

FOREIGN PATENT DOCUMENTS 4-72438 3/1992 Japan .

*Primary Examiner*—Douglas Hart
*Attorney, Agent, or Firm*—Foley & Lardner

[57] ABSTRACT

In an internal combustion engine with oxygen sensors provided respectively upstream and downstream of an exhaust purification catalytic converter, the air-fuel ratio is feedback controlled based on an output of the second oxygen sensor only. When in this control situation, an output period of the first oxygen sensor becomes longer than that of the second oxygen sensor, response deterioration of the first oxygen sensor is judged to have occurred. Once the occurrence of response deterioration is determined, a proportional operating amount used in a proportional control of an air-fuel ratio feedback correction coefficient LMD for air-fuel ratio feedback control using the first oxygen sensor, is corrected in proportion to the response deterioration to thereby correct a deviation of the air-fuel ratio control point.

As a result, response deterioration of the first oxygen sensor can be diagnosed, and deviation of the air-fuel ratio control point due to the response deterioration can be avoided, so that control accuracy to the target air-fuel ratio can be ensured.

14 Claims, 6 Drawing Sheets

APPARATUS AND METHOD FOR CONTROLLING THE AIR-FUEL RATIO OF AN INTERNAL COMBUSTION ENGINE

FIELD OF THE INVENTION

The present invention relates to a apparatus and method for controlling the air-fuel ratio of an internal combustion engine, and in particular, to technology for diagnosing deterioration of an oxygen sensor in a system wherein the air-fuel ratio is feedback controlled using an oxygen sensor provided upstream of an exhaust purification catalytic converter, and making corrections depending on deterioration of the oxygen sensor.

DESCRIPTION OF THE RELATED ART

Heretofore, there have been various proposals for air-fuel ratio feedback control systems wherein the air-fuel ratio is feedback controlled based on detection values from two oxygen sensors respectively disposed upstream and downstream of a three way catalytic converter for exhaust purification arranged in the exhaust passage (Japanese Unexamined Patent Publication No 4-72438).

Such apparatus, wherein the air-fuel ratio is feedback controlled using two oxygen sensors, make use of a feature that variations in the detection characteristics of the oxygen sensor downstream of the catalytic converter are smaller than those for the oxygen sensor upstream of the catalytic converter. A rich/lean shift in the air-fuel ratio feedback control using the upstream oxygen sensor due to a rich shift or lean shift in the detection characteristics of the upstream oxygen sensor can thus be detected based on detection results of the downstream oxygen sensor, and a correction is made on to the air-fuel ratio feedback control based on the detection results.

Conventionally however, the arrangements have been such that the results of feedback control using the upstream oxygen sensor, are detected by the downstream oxygen sensor at a low response speed due to an oxygen storage effect of the catalyst. Therefore, while it is possible to maintain the air-fuel ratio on average at a target air-fuel ratio based on the results detected by the downstream oxygen sensor at that time, it is not possible to accurately diagnose, from the detected results of the downstream oxygen sensor, a change in the characteristics of the upstream oxygen sensor, so that accurate stabilization at the target air-fuel ratio becomes difficult.

SUMMARY OF THE INVENTION

In view of the foregoing, it is an object of the present invention to be able to diagnose to a good accuracy a change in the characteristics of the oxygen sensor on the upstream side of the catalytic converter.

It is a further object of the present invention to be able to accurately stabilize the air-fuel ratio at the target air-fuel ratio irrespective of a change in the characteristics of the oxygen sensor on the upstream side of the catalytic converter, by correcting the characteristics of the air-fuel ratio feedback control in accordance with the change in the characteristics of the oxygen sensor.

To achieve the above objective, the apparatus and method for controlling the air-fuel ratio of an internal combustion engine according to the present invention, employs a first oxygen sensor and a second oxygen sensor provided on upstream and downstream sides respectively of an exhaust purification catalytic converter arranged in an exhaust passage of the engine, for detecting oxygen concentration in the exhaust gas. The air-fuel ratio of the engine intake mixture is feedback controlled to a target air-fuel ratio based on detection results of the first oxygen sensor, and when a diagnostic condition of the first oxygen sensor is realized, air-fuel ratio feedback control using the first oxygen sensor is stopped, and the air-fuel ratio is feedback controlled based on an output of the second oxygen sensor only. In the situation wherein the air-fuel ratio is feedback controlled based on the second oxygen sensor, respective output characteristics of the first oxygen sensor and the second oxygen sensor are compared, and diagnosis to determine deterioration of the first oxygen sensor is made based on results of the comparison.

With such a construction, when diagnosing deterioration of the first oxygen sensor used in the air-fuel ratio feedback control, air-fuel ratio feedback control is carried out based only on the detection results of the second oxygen sensor downstream of the catalytic converter, without using the first oxygen sensor.

Due to the oxygen storage effect of the catalyst, a delay in response compared to that of the first oxygen sensor arises in the second oxygen sensor downstream of the catalyst. As a result, when the air-fuel ratio is feedback controlled based on detection results of the first oxygen sensor, the fluctuation characteristics of the air-fuel ratio differ between upstream and downstream of the catalytic converter. However, if the air-fuel ratio is feedback controlled based only on the output of the second oxygen sensor, then the air-fuel ratio of the engine is controlled according to the detection response speed of the second oxygen sensor, so that approximately similar oxygen concentration changes are shown between upstream and downstream of the catalytic converter.

Accordingly, when the detection values of the first oxygen sensor and second oxygen sensor do not show these approximately similar changes expected for when the air-fuel ratio is controlled using only the second oxygen sensor, then it can be presumed that the change in detection characteristics is due to deterioration of the first oxygen sensor.

The construction may be such that deterioration diagnosis of the first oxygen sensor involves comparing a period of the first oxygen sensor output with a period of the second oxygen sensor output in the situation of air-fuel ratio feedback control using the second oxygen sensor, to thereby judge if the first oxygen sensor is deteriorated.

With such a construction, a change in the response characteristics due to deterioration of the first oxygen sensor can be determined by judging the period of the first oxygen sensor output, with the period of the second oxygen sensor output as a reference.

Here the construction may be such that deterioration of the first oxygen sensor is judged when a period of the first oxygen sensor output is longer than a period of the second oxygen sensor output.

With such a construction, a response delay occurrence due to deterioration of the first oxygen sensor can be judged based on the fact that the period of the first oxygen sensor output is longer than that of the second oxygen sensor output.

Preferably the construction may involve, comparing the outputs of the first and second oxygen sensors with a reference output corresponding to the target air-fuel ratio, and respectively measuring a continuous time during which the air-fuel ratio is richer than the target air-fuel ratio, and a continuous time during which the air-fuel ratio is leaner than the target air-fuel ratio, and respectively computing differences in the rich continuous times and lean continuous times between the first and second oxygen sensors, and diagnosing deterioration of the first oxygen sensor based on the computed differences.

With such a construction, by separating the lean continuous times from the rich continuous times, and comparing the period of the first and second oxygen sensors, then it is possible to determine if the air-fuel ratio control point has deviated towards the rich side or towards the lean side due to a response delay of the first oxygen sensor.

Preferably the construction may involve correcting the control characteristics in the air-fuel ratio feedback control carried out using the first oxygen sensor, based on the results of the deterioration diagnosis of the first oxygen sensor.

With such a construction, the characteristics of the air-fuel ratio feedback control carried out based on detection results of the first oxygen sensor, can be kept from being deviated from the expected characteristics due to deterioration of the first oxygen sensor.

Moreover, the construction may be such that the deterioration diagnosis of the first oxygen sensor employs a construction for diagnosing a change in response characteristics of the first oxygen sensor, and the air-fuel ratio control point in a step wherein the air-fuel ratio is feedback controlled using the first oxygen sensor, is corrected based on the change in response characteristics.

With such a construction, when the control point for the air-fuel ratio feedback control carried out based on detection results of the first oxygen sensor deviates from a target due to a change in the response characteristics of the first oxygen sensor, this deviation can be corrected for so that the air-fuel ratio is feedback controlled to the target air-fuel ratio.

Moreover, the construction may be such that air-fuel ratio feedback control using the first oxygen sensor employs a construction wherein an air-fuel ratio control value is proportional-plus-integral controlled, and a proportional operating amount in the proportional-plus-integral control is corrected based on a result of the deterioration diagnosis of the first oxygen sensor.

With such a construction, the deviation of the air-fuel ratio control point due to response deterioration of the first oxygen sensor can be adjusted by correction of the proportional operating amount, so that the air-fuel ratio is feedback controlled to the target air-fuel ratio.

Other objects and aspects of the present invention will become apparent from the following description of an embodiment given in conjunction with the appended drawings.

DETAILED DESCRIPTION OF THE PREFERRED EMBODIMENT

Figure 1:
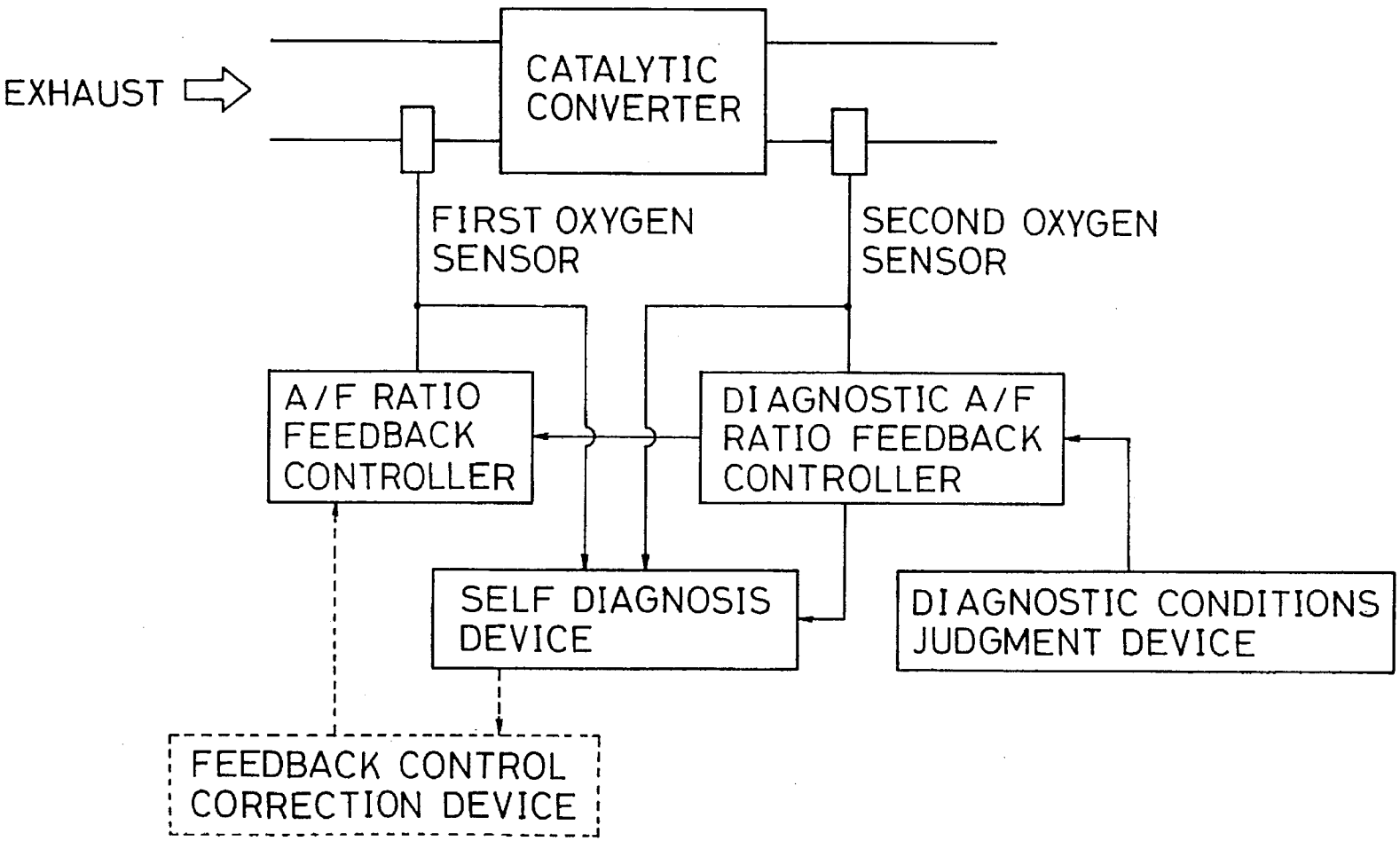
FIG. 1 is a block diagram showing a basic arrangement of an air-fuel ratio control apparatus according to the present invention.

A basic arrangement of an air-fuel ratio control apparatus for an internal combustion engine according to the present invention is shown in FIG. 1, while an embodiment of the apparatus and method for controlling the air-fuel ratio of an internal combustion engine according to the present invention is shown in FIG. 2 through FIG. 6.

Figure 2:
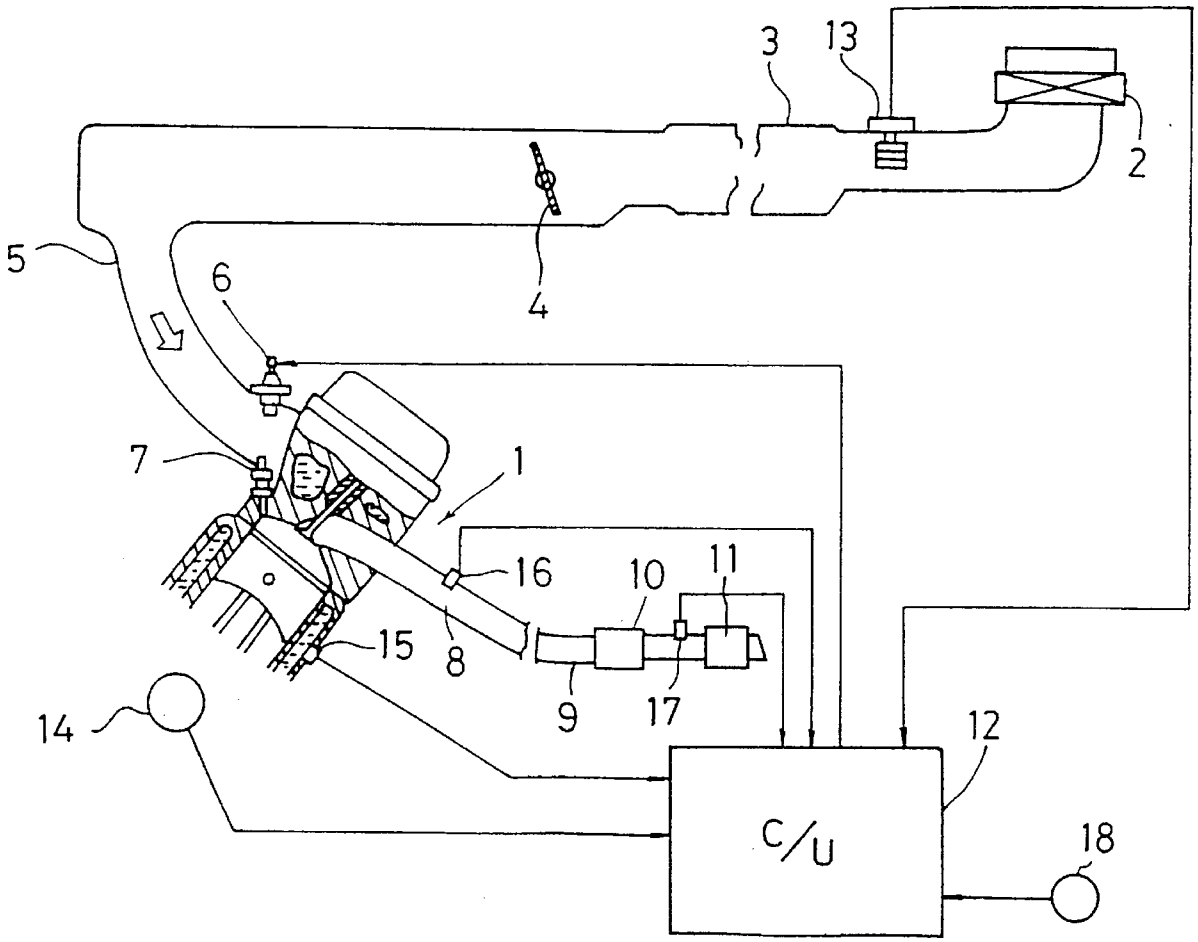
FIG. 2 is a schematic system diagram illustrating an embodiment of the present invention.

Referring to the system structure of the embodiment shown in FIG. 2, an internal combustion engine 1 draws in air from an air cleaner 2 by way of an intake duct 3, throttle valve 4, and intake manifold 5.

Fuel injection valves 6 are provided for each cylinder in respective branch portions of the intake manifold 5. The fuel injection valves 6 are electromagnetic type fuel injection valves which open with power to a solenoid and close with power shut-off. The injection valves 6 are driven open in response to an injection pulse signal provided by a control unit 12 (to be described later) so that fuel pressurized by a fuel pump (not shown), and controlled to a predetermined pressure by means of a pressure regulator, is injected to inside the intake manifold 5.

Ignition plugs 7 are provided for each combustion chamber of the engine 1 for spark ignition of an air-fuel mixture therein.

Exhaust from the engine 1 is discharged by way of an exhaust manifold 8, an exhaust duct 9, a three-way catalytic converter 10 for exhaust purification (exhaust purification catalytic converter) and a muffler 11. The three-way catalytic converter 10 which is one having the beforementioned oxygen storage effect, reduces the $NO_x$ and oxidizes the CO and HC present in the exhaust gas, converting them into other harmless substances, with the conversion efficiencies for these reactions being at an optimum when the engine intake mixture is burnt at the theoretical air-fuel ratio.

The control unit 12 incorporates a microcomputer having a CPU, ROM, RAM, A/D converter and input/output interface. Detection signals from the various sensors are input to the control unit 12, and computational processing carried out (as described later) to thereby control the operation of the fuel injection valves 6.

For the various sensors there is provided in the intake duct 3, an airflow meter 13 such as hot wire type or flap type airflow meter, which outputs a signal corresponding to the intake air quantity Q of the engine 1.

Also provided is a crank angle sensor 14 which outputs a reference crank angle signal REF for each predetermined piston position, and a unit crank angle signal POS for each unit crank angle. The period of the reference crank angle signal REF, or the number of unit crank angle signals POS for a predetermined period is measured, to compute the engine rotational speed Ne.

Moreover, a water temperature sensor 15 is provided for detecting the cooling water temperature Tw in the water jacket of the engine 1.

There is also a first oxygen sensor 16 provided at a junction portion of the exhaust manifold 8 on the upstream side of the three-way catalytic converter 10, and a second oxygen sensor 17 provided on a downstream side of the three-way catalytic converter 10 and an upstream side of the muffler 11.

The first oxygen sensor 16 and second oxygen sensor 17 are known sensors whose output values change in response to the concentration of oxygen in the exhaust gas. They are rich/lean sensors which utilize the fact that the concentration of oxygen in the exhaust gas drastically changes around the theoretical air-fuel ratio, to detect if the exhaust air-fuel ratio is richer or leaner than the theoretical air-fuel ratio.

Also provided is a vehicle speed sensor 18 for detecting the running speed VSP (vehicle speed) of the vehicle fitted with the engine 1.

Figure 3:
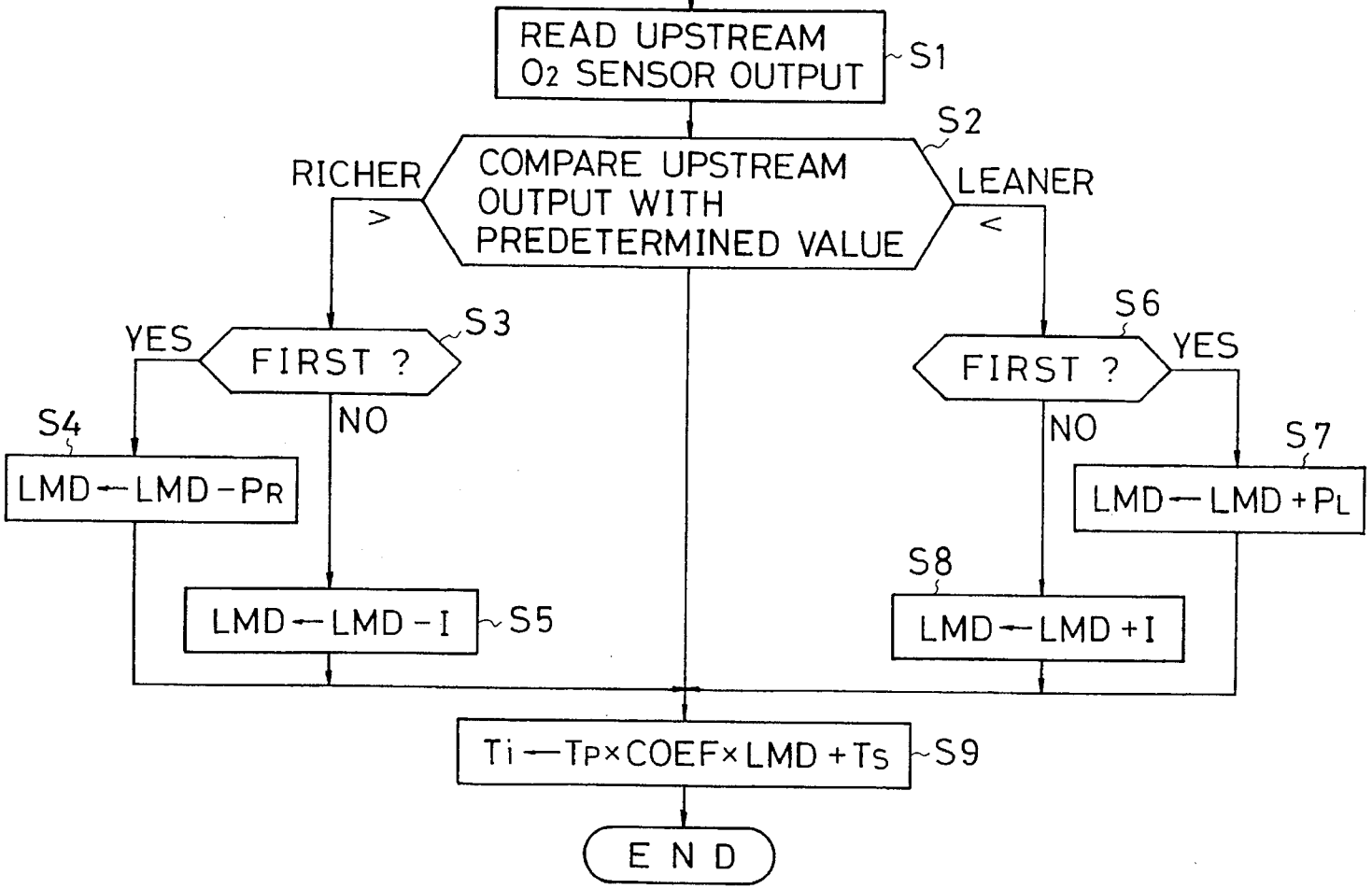
FIG. 3 is a flow chart showing an air-fuel ratio feedback control routine according to the embodiment.
Figure 4:
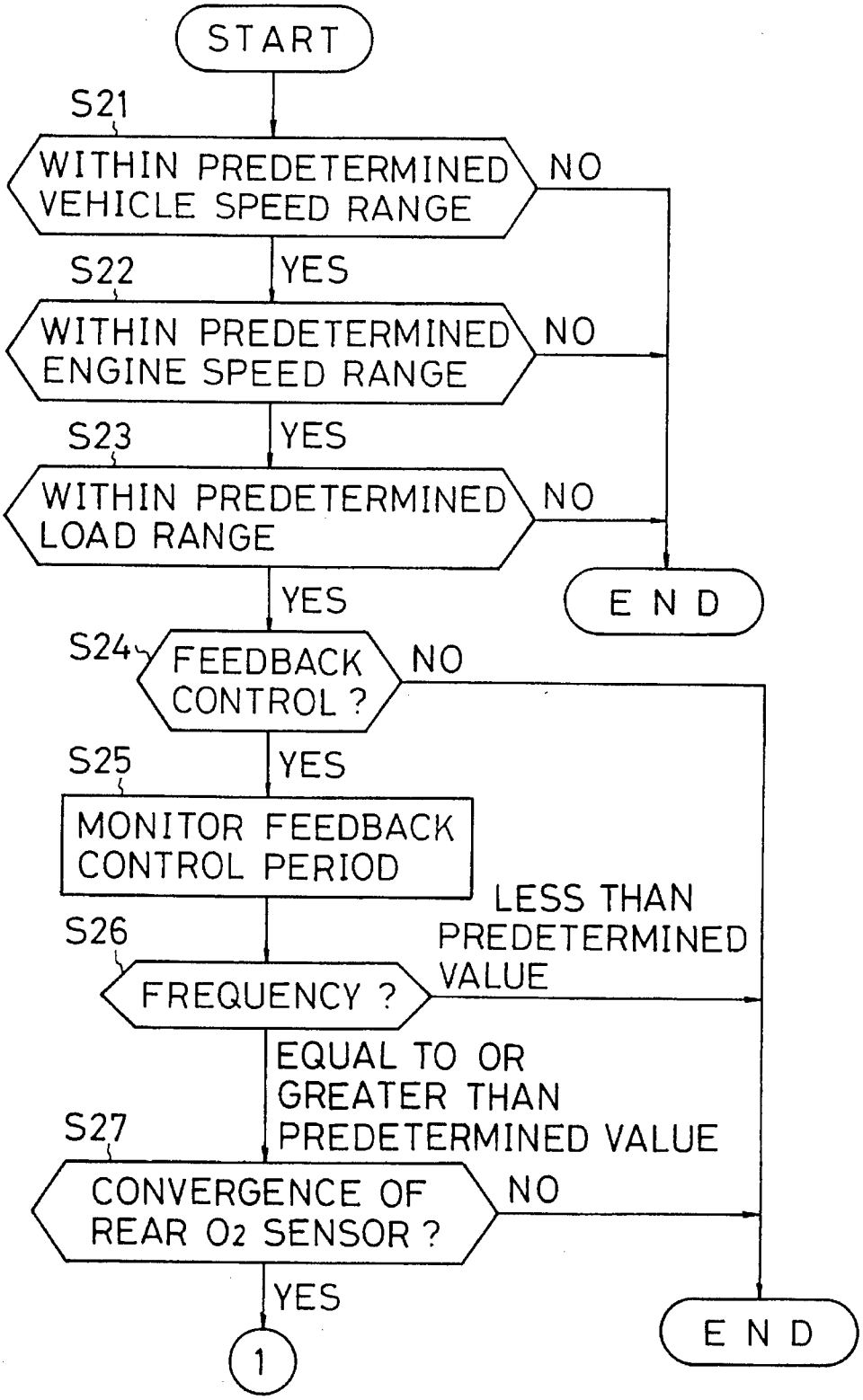
FIG. 4 is a flow chart showing a first oxygen sensor diagnosis control and correction control routine according to the embodiment.
Figure 5:
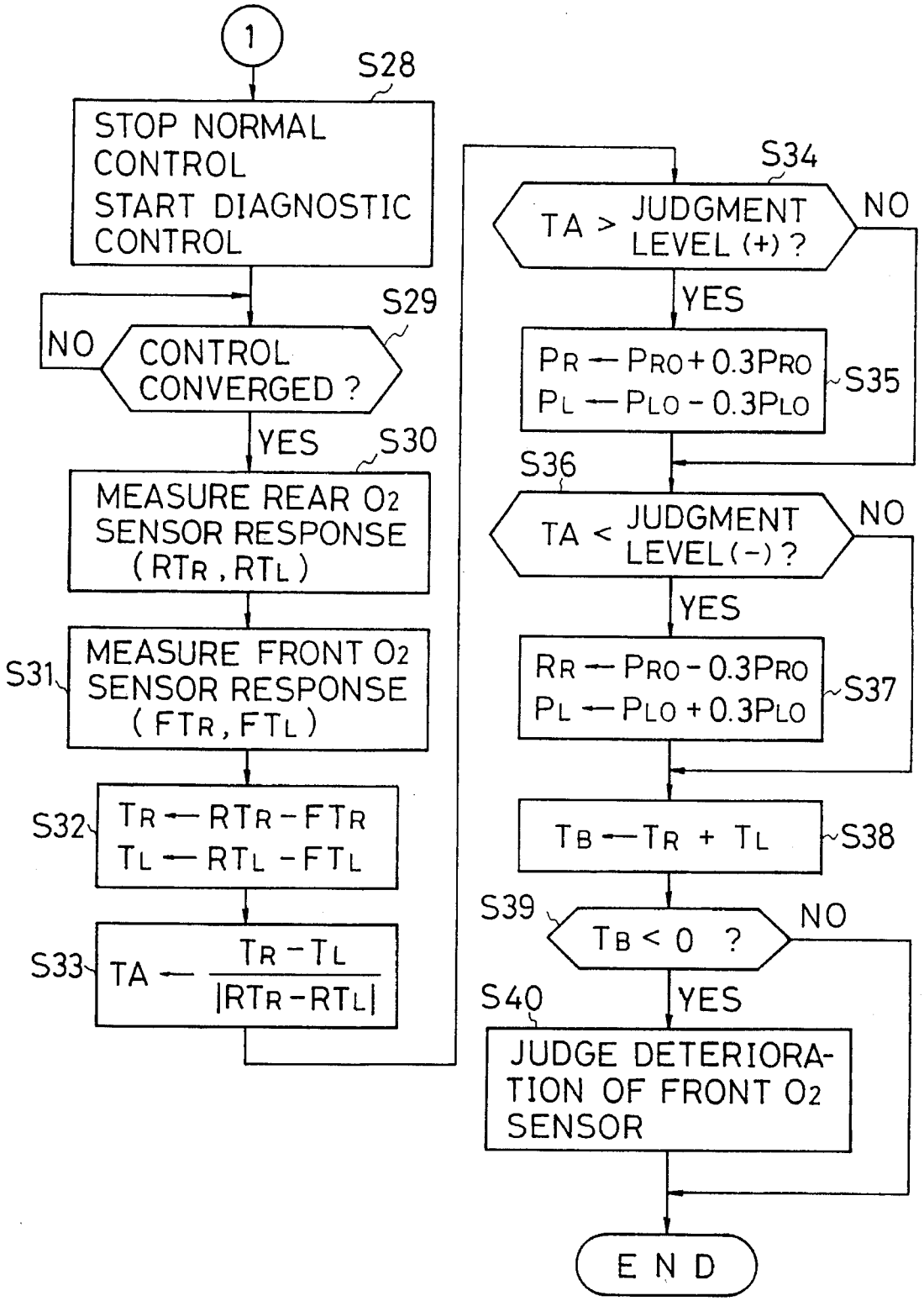
FIG. 5 is a flow chart showing a continuation of the first oxygen sensor diagnosis control and correction control routine according to the embodiment.
Figure 6:
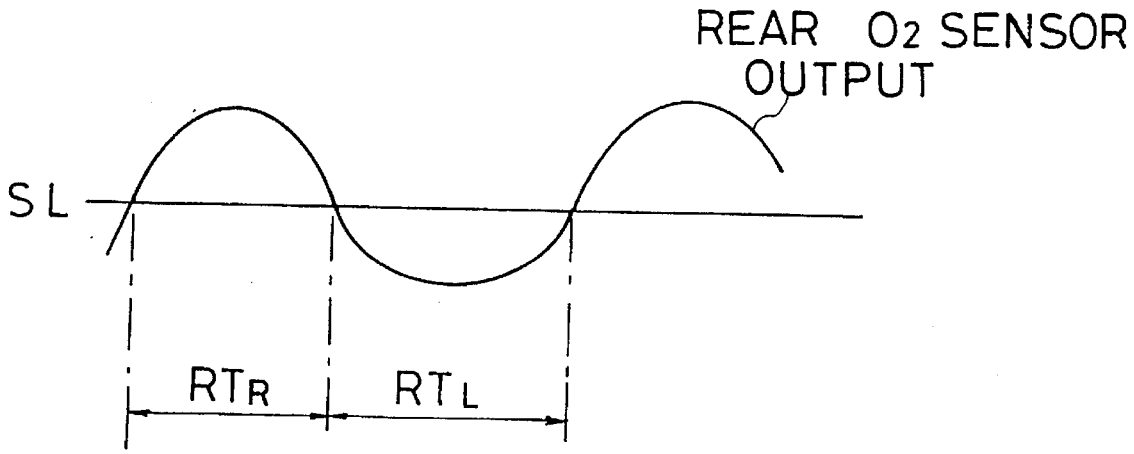
FIG. 6 is a time chart showing a diagnosis parameter according to the embodiment.

The CPU of the microcomputer in the control unit 12 electronically controls the fuel supply to the engine during air-fuel ratio feedback control, according to programs in the ROM, as illustrated respectively by the flow charts of FIG. 3 through FIG. 5.

In the present embodiment, the functions of an air-fuel ratio feedback controller, a diagnostic conditions judgment device, a diagnostic air-fuel ratio feedback controller, a self diagnosis device and a feedback controller correction device as shown in FIG. 1, are realized by software illustrated by the flow charts of FIG. 3 through FIG. 5 and stored in the control unit 12.

The program illustrated by the flow chart of FIG. 3 is for setting by proportional-plus-integral control, an air-fuel ratio feedback correction coefficient LMD according to the detection results of the first oxygen sensor 16, and controlling correction of the fuel injection quantity based on the set air-fuel ratio feedback correction coefficient LMD.

In the flow chart of FIG. 3, initially in step 1 (with "step" denoted by S in the figures), the output voltage of the upstream first oxygen sensor 16 is read.

Then in step 2, the output voltage read in step 1, is compared with a predetermined value corresponding to the target air-fuel ratio (theoretical air-fuel ratio) to judge if the actual air-fuel ratio is richer or leaner than the target air-fuel ratio.

When the output voltage is greater than the predetermined value so that the air-fuel ratio is judged richer, control proceeds to step 3 where it is judged if this is the first rich judgment.

If the first rich judgment, control proceeds to step 4, where a proportional control involving subtracting a proportional portion $P_R$ (set as described later) from a previous air-fuel ratio feedback correction coefficient LMD is carried out to update the air-fuel ratio feedback correction coefficient LMD.

When judged in step 3 not to be the first rich judgment, control proceeds to step 5 where integral control involving subtracting a predetermined integral portion I from the previous air-fuel ratio feedback correction coefficient LMD is carried out to update the air-fuel ratio feedback correction coefficient LMD.

This reduction control of the air-fuel ratio feedback correction coefficient LMD corresponds to a correction to reduce the fuel injection quantity Ti. Hence repetition of the integral control in step 5, changes the air-fuel ratio to a lean air-fuel ratio.

When judged in step 2 that the air-fuel ratio has been changed to a leaner air-fuel ratio, control proceeds to step 6 where it is judged if this is the first lean judgment.

If the first lean judgment, control proceeds to step 7 where a proportional control involving adding a proportional portion $P_L$ (set as described later) to the previous air-fuel ratio feedback correction coefficient LMD is carried out to update the air-fuel ratio feedback correction coefficient LMD.

When judged not to be the first lean judgment, control proceeds to step 8 where integral control involving adding a predetermined integral portion I to the previous air-fuel ratio feedback correction coefficient LMD is carried out to update the air-fuel ratio feedback correction coefficient LMD.

The air-fuel ratio feedback correction coefficient LMD is thus proportional-plus-integral controlled so that the actual air-fuel ratio detected by the upstream first oxygen sensor 16 becomes close to the target air-fuel ratio. Control then proceeds to step 9 where the basic fuel injection quantity Tp is corrected using the air-fuel ratio feedback correction coefficient LMD, to thus set a final fuel injection quantity Ti.

More specifically, the basic fuel injection quantity Tp ($Tp=K\times Q/Ne$: where K is a constant) is computed based on the intake air quantity Q and the engine rotational speed Ne, and also computed are various correction coefficients COEF based on operating conditions such as the cooling water temperature Tw, and a voltage correction amount Ts corresponding to battery voltage. The basic fuel injection quantity Tp is then corrected using the air-fuel ratio feedback correction coefficient LMD, the various correction coefficients COEF, and the voltage correction amount Ts, and the corrected result is set as the final fuel injection quantity Ti ($Ti=Tp\times COEF\times LMD+Ts$).

The control unit 12 outputs to the fuel injection valve 6 at a predetermined injection timing, an injection pulse signal having a pulse width corresponding to the most recently computed fuel injection quantity Ti, thus controlling the injection quantity from the fuel injection valve 6 to produce an air-fuel mixture having the target air-fuel ratio.

Here the proportional portions $P_R$, $P_L$ used in the proportional-plus-integral control of the air-fuel ratio feedback correction coefficient LMD are variably set in accordance with a program illustrated by the flow charts of FIG. 4 and FIG. 5.

Referring to the flow charts of FIG. 4 and FIG. 5, initially in steps 21 through 23 the medium speed/steady operating condition of the engine is determined by judging if the vehicle speed VSP, engine rotational speed Ne and basic fuel injection quantity Tp (engine load) are within respective predetermined ranges.

The medium speed/steady operating condition of the engine corresponds to conditions which the oxygen storage effect of the three-way catalytic converter 10 is stabilized.

When a predetermined medium speed/steady operating condition is detected by the judgments of step 21 through step 23, control proceeds to step 24 where it is judged if air-fuel ratio feedback control is being carried out according to the flow chart of FIG. 3 using the first oxygen sensor 16.

When judged that air-fuel ratio feedback control is being carried out, control proceeds to step 25 where the frequency of the air-fuel ratio feedback control is monitored. That is to say the rich/lean change cycle of the air-fuel ratio detected by the first oxygen sensor 16, due to the feedback control, is monitored.

Then in the next step 26, it is judged if the frequency of the air-fuel ratio feedback control is equal to or above a predetermined value.

By judging in this way, the time when the frequency of the rich/lean change detected by the upstream first oxygen sensor 16 is equal to or above a predetermined value during air-fuel ratio feedback control is judged. Since immediately after a situation wherein a large amount of oxygen has been absorbed in the three-way catalytic converter 10 due to lean control by fuel shut-off and the like, changes to a situation of air-fuel ratio feedback control with the theoretical air-fuel ratio as the target air-fuel ratio, the output of the second oxygen sensor 17 is not changed due to an influence of the absorbed oxygen, the condition causing the change in the output of the second oxygen sensor 17 is detected based on the judgement mentioned above.

When judged in step 26 that the rich/lean change frequency is equal to or above a predetermined value, control proceeds to step 27 where it is judged if the output of the second oxygen sensor 17 has converged.

When the output of the downstream second oxygen sensor 17 has converged in other words, when there is a diminishing of the influence from the oxygen storage effect of the three-way catalytic converter 10 which has arisen during lean control by fuel shut-off and the like, then the diagnosis conditions for the first oxygen sensor 16 are judged to have materialized, and control proceeds to step 28 to carry out diagnosis of the first oxygen sensor 16.

In step 28, the setting of the air-fuel ratio feedback correction coefficient LMD using the first oxygen sensor 16 is terminated, and instead the correction coefficient LMD is set, in a similar manner to that of the flow chart of FIG. 3 but based on the detected results of the second oxygen sensor 17, as a diagnostic air-fuel ratio feedback control for diagnosing the detection characteristics of the first oxygen sensor 16.

That is to say, by feedback controlling the air-fuel ratio based on results detected by the second oxygen sensor 17 with a response delay due to the influence of the oxygen storage effect of the three-way catalytic converter 10, then an air-fuel ratio change which has been influenced by the response delay is also sensed by the upstream oxygen sensor 16.

Then, when judged in step 29 that the output of the second oxygen sensor 17 has been stabilized to a constant self excitation control waveform by air-fuel ratio feedback control using the second oxygen sensor 17, control proceeds to step 30.

In step 30, a rich continuous time RTR and a lean continuous time RTL (see FIG. 6) detected for the second oxygen sensor 17 are respectively calculated under stable air-fuel ratio feedback control using the output of the second oxygen sensor 17.

Similarly, in step 31, the rich continuous time FTR and the lean continuous time FTL detected for the first oxygen sensor 16, are respectively calculated under stable air-fuel ratio feedback control using the output of the second oxygen sensor 17.

Then, in step 32, a difference TR between the rich continuous time RTR and the rich continuous time FTR (TR=RTR−FTR), and a difference TL between the lean continuous time RTL and the lean continuous time FTL (TL=RTL−FTL) are computed.

Furthermore, in step 33, the difference between the two differences TR and TL is divided by the absolute value of the difference between the rich continuous time RTR and lean continuous time RTL detected by the second oxygen sensor 17, and the resultant value set to TA (TA=(TR−TL)/|RTR−RTL|).

Here, when there is assumed to be no deterioration in detection characteristics of the second oxygen sensor 17 downstream of the catalytic converter, then the times RTR and RTL become the reference values. For example, when the lean continuous time FTL becomes longer than initially, due to a change in the detection characteristics of the first oxygen sensor 16, the judgment value TA changes to a larger value than the initial value on the positive side. Conversely, when the rich continuous time FTR becomes longer than initially due to a change in the detection characteristics of the first oxygen sensor 16, the judgment value TA changes to a larger value than the initial value on the negative side.

In the next step 34, the judgment value TA is compared with a positive judgment level (+) for judging a change in the judgment value TA to the positive side.

When the judgment value TA is greater than the judgment level (+), it is judged that the characteristic change causing the lean continuous time FTL of the first oxygen sensor 16 to become longer has occurred (lean shift deterioration causing a response delay of rich detection) and the control point for air-fuel ratio feedback control using the first oxygen sensor 16 has shifted to the rich side. Control then proceeds to step 35.

In step 35, the proportional portion PR used in the reduction control of the correction coefficient LMD in the proportional control of the flow chart of FIG. 3 is incremented, while the proportional portion PL used in the increase control of the correction coefficient LMD is decremented. As a result correction is made to shift the characteristics of the feedback control towards the leans side, thus offsetting the rich shift trend during control using the first oxygen sensor.

On the other hand, when judged in step 34 that the judgment value TA is smaller than the judgment level (+), it is judged that at least a rich shift of the feedback control has not occurred, and control proceeds to step 36.

In step 36, the judgment value TA is compared with a negative judgment level (−) for judging a change of the judgment value TA to the negative side.

When the judgment value TA is less than the judgment level (−), it is judged that a characteristic change causing the rich continuous time FTR of the first oxygen sensor 16 to become: longer than initially has occurred (rich shift deterioration causing a response delay of lean detection) and the control point for air-fuel ratio feedback control using the first oxygen sensor 16 has shifted to the lean side. Control then proceeds to step 37.

In step 37, to correct the lean shift of the feedback control point, the proportional portion PR used in the reduction control of the correction coefficient LMD is decremented, while the proportional portion PL used in the increase control of the correction coefficient LMD is incremented.

When on the other hand, the judgment value TA is within a range between the judgment levels (+) and (−), it is considered that a significant rich or lean shift of the first oxygen sensor 16 has not occurred, so that correction of the proportional portions to adjust the control point in the air-fuel ratio feedback control using the first oxygen sensor 16 is not required. Control therefore proceeds to step 38.

In step 38, the sum TB of the differences TR and TL (TB=TR+TL)is computed, and in the next step 39 it is judged if the sum TB is a negative value.

In the condition of air-fuel ratio feedback control using only the downstream second oxygen sensor 17 (diagnostic air-fuel ratio feedback control condition), the rich/lean continuous times RTR and RTL of the downstream second oxygen sensor 17 will be longer than the rich/lean continuous times FTR and FTL of the upstream first oxygen sensor 16, due to influence from the oxygen storage effect of the three-way catalytic converter 10.

Accordingly, in normal conditions, then the computed differences TR and TL, will both have a positive value.

Hence, if the beforementioned sum TB (TB= TR+TL) has a negative value, it can be assumed that the first oxygen sensor 16 has significant response delay deterioration, so that it is close to its useful limit.

Therefore, when in step 39 the sum TB (TB=TR+TL) is judged to be negative, control proceeds to step 40 where deterioration of the first oxygen sensor 16 is advised.

The present embodiment employs a construction wherein the control point of the air-fuel ratio feedback control using the first oxygen sensor 16 is adjusted by correcting the proportional portion. However, a construction is also possible wherein the control point of the air-fuel ratio feedback control is adjusted, for example by changing a threshold level such as the value SL in FIG. 6 used in the rich/lean judgment based on the output of the first oxygen sensor 16, and/or by changing a time which forcibly delays execution of the proportional control for rich/lean detection by the first oxygen sensor 16.

I claim:

1. An apparatus for controlling the air-fuel ratio of an internal combustion engine, said apparatus comprising;

an exhaust purification catalytic converter arranged in an exhaust passage of the engine, a first oxygen sensor provided upstream of said exhaust purification catalytic converter, for detecting oxygen concentration in the exhaust gas, air-fuel ratio feedback control means for feedback control of an air-fuel ratio of the engine intake mixture to a target air-fuel ratio, based on detection results of the first oxygen sensor, a second oxygen sensor provided downstream of said exhaust purification catalytic converter, for detecting oxygen concentration in the exhaust gas, diagnostic condition judgment means for judging a diagnostic condition of said first oxygen sensor, diagnostic air-fuel ratio feedback control means for stopping air-fuel ratio feedback control with said air-fuel ratio feedback control means when judged by said diagnostic condition judgment means that a diagnostic condition has been realized, and instead carrying out feedback control of the air-fuel ratio of the engine intake mixture to a target air-fuel ratio, based only on output values of said second oxygen sensor, self diagnosis means for comparing respective output characteristics of said first and second oxygen sensors in the situation of feedback control by said diagnostic air-fuel ratio feedback control means, and diagnosing deterioration of said first oxygen sensor based on results of the comparison.

2. An apparatus for controlling the air-fuel ratio of an internal combustion engine according to claim 1, wherein said self diagnosis means compares a period of the first oxygen sensor output with a period of the second oxygen sensor output in the situation of air-fuel ratio feedback control by said diagnostic air-fuel ratio feedback control means, to thereby judge a deterioration condition of the first oxygen sensor.

3. An apparatus for controlling the air-fuel ratio of an internal combustion engine according to claim 2, wherein said self diagnosis means judges deterioration of the first oxygen sensor when a period of the first oxygen sensor output is longer than a period of the second oxygen sensor output.

4. An apparatus for controlling the air-fuel ratio of an internal combustion engine according to claim 2, wherein said self diagnosis means compares the output of the first and second oxygen sensors with a reference output corresponding to the target air-fuel ratio, and measures the continuous times during which the air-fuel ratio is richer than the target air-fuel ratio, and the continuous times during which the air-fuel ratio is leaner than the target air-fuel ratio, and computes the differences in the rich continuous times and lean continuous times between the first and second oxygen sensors, and makes a diagnosis of deterioration of the first oxygen sensor based on the computed differences.

5. An apparatus for controlling the air-fuel ratio of an internal combustion engine according to claim 1, wherein a feedback control correction means is provided for correcting the control characteristics of the air-fuel ratio feedback control means, based on the diagnostic result from said self diagnosis means.

6. An apparatus for controlling the air-fuel ratio of an internal combustion engine according to claim 5, wherein said self diagnosis means is constructed so as to diagnose a change in response characteristics of the first oxygen sensor, and said feedback control correction means corrects an air-fuel ratio control point in said air-fuel ratio feedback control means, based on the change in response characteristics.

7. An apparatus for controlling the air-fuel ratio of an internal combustion engine according to claim 5, wherein said air-fuel ratio feedback control means employs a construction wherein an air-fuel ratio control value is proportional-plus-integral controlled, and said feedback control correction means corrects a proportional operating amount in said air-fuel ratio feedback control means, based on a diagnostic result from said self diagnosis means.

8. A method of controlling the air-fuel ratio of an internal combustion engine employing a first oxygen sensor provided upstream of an exhaust purification catalytic converter arranged in an exhaust passage of the engine, for detecting oxygen concentration in the exhaust gas, and a second oxygen sensor provided downstream of said exhaust purification catalytic converter, for detecting the oxygen concentration in the exhaust gas, said method including the steps of; feedback controlling the air-fuel ratio of the engine intake mixture to a target air-fuel ratio based on detection results of said first oxygen sensor, judging a diagnostic condition of the first oxygen sensor, stopping air-fuel ratio feedback control using the first oxygen sensor when a diagnostic condition of the first oxygen sensor is realized, and instead carrying out feedback control of the air-fuel, ratio of the engine intake mixture to a target air-fuel ratio, based only on output values of said second oxygen sensor, and in the situation of air-fuel ratio feedback control using the second oxygen sensor, comparing the respective output characteristics of the first and second oxygen sensor, and diagnosing deterioration-of the first oxygen sensor based on results of the comparison.

9. A method of controlling the air-fuel ratio of an internal combustion engine according to claim 8, wherein said step of diagnosing deterioration of the first oxygen sensor involves, comparing a period of the first oxygen sensor output with a period of the second oxygen sensor output in said situation of air-fuel ratio feedback control using said second oxygen sensor, to judge if the first oxygen sensor is deteriorated.

10. A method of controlling the air-fuel ratio of an internal combustion engine according to claim 9, wherein said step of diagnosing deterioration of the first oxygen sensor involves, judging deterioration of the first oxygen sensor when a period of the first oxygen sensor output is longer than a period of the second oxygen sensor output.

11. A method of controlling the air-fuel ratio of an internal combustion engine according to claim 9, wherein said step of diagnosing deterioration of the first oxygen sensor involves, comparing the output of the first and second oxygen sensors with a reference output corresponding to the target air-fuel ratio, and respectively measuring continuous times during which the air-fuel ratio is richer than the target air-fuel ratio, and continuous times during which the air-fuel ratio is leaner than the target air-fuel ratio, and respectively computing the differences in the rich continuous times and lean continuous times between the first and second oxygen sensors, and diagnosing deterioration of the first oxygen sensor based on the computed differences.

12. A method of controlling the air-fuel ratio of an internal combustion engine according to claim 8, wherein a step is provided for correcting the control characteristics in the step for air-fuel ratio feedback control using the first oxygen sensor, based on a diagnostic results of the step of diagnosing deterioration of the first oxygen sensor.

13. A method of controlling the air-fuel ratio of an internal combustion engine according to claim 12, wherein said step of diagnosing deterioration of the first oxygen sensor employs a construction for diagnosing a change in response characteristics of the first oxygen sensor, and said step for correcting the control characteristics corrects an air-fuel ratio control point in the step of air-fuel ratio feedback control using the first oxygen sensor, based on the change in response characteristics.

14. A method of controlling the air-fuel ratio of an internal combustion engine according to claim 12, wherein said step of air-fuel ratio feedback control using the first oxygen sensor is constructed so as to proportional-plus-integral control the air-fuel ratio control value, and said step of correcting the control characteristics corrects a proportional operating amount of said proportional-plus-integral control, based on a diagnostic result of the step of diagnosing deterioration of the first oxygen sensor.

* * * * *